United States Patent [19]

Keiter et al.

[11] 4,431,324

[45] Feb. 14, 1984

[54] SOUND DAMPING RIBBON CARTRIDGE FOR A TYPEWRITER OR SIMILAR OFFICE MACHINE

[75] Inventors: Alfred Keiter; Bernd Tappehorn, both of Wilhelmshaven, Fed. Rep. of Germany

[73] Assignee: Olympia Werke AG, Wilhelmshaven, Fed. Rep. of Germany

[21] Appl. No.: 329,985

[22] Filed: Dec. 11, 1981

[30] Foreign Application Priority Data

Dec. 13, 1980 [DE] Fed. Rep. of Germany ..... 3046997
Dec. 13, 1980 [DE] Fed. Rep. of Germany ..... 3046998

[51] Int. Cl.[3] ..... B41J 29/02

[52] U.S. Cl. ..... 400/689; 400/208; 181/201

[58] Field of Search ..... 400/194, 195, 196, 196.1, 400/207, 208, 208.1, 689; 181/201, 205, 40, 284, 292, 294

[56] References Cited

U.S. PATENT DOCUMENTS

| | | | |
|---|---|---|---|
| 888,438 | 5/1908 | Hess et al. | 400/689 X |
| 1,419,293 | 6/1922 | Myers | 400/689 X |
| 1,972,563 | 9/1934 | Irvin | 181/292 |
| 3,656,576 | 4/1972 | Gubela | 181/210 |
| 3,960,259 | 6/1976 | Guerrini et al. | 400/208 |
| 4,035,535 | 7/1977 | Taylor | 181/292 X |
| 4,235,664 | 11/1980 | Menke | 400/144.2 X |

FOREIGN PATENT DOCUMENTS

| | | | |
|---|---|---|---|
| 784029 | 4/1968 | Canada | 181/294 |
| 33532 | 8/1981 | European Pat. Off. | 400/208 |
| 2904488 | 8/1980 | Fed. Rep. of Germany | 400/208 |

OTHER PUBLICATIONS

*IBM Technical Disclosure Bulletin,* "Noise Reduction Feature for Typewriters", Irving, vol. 18, No. 7, Dec. 1975, p. 2217.

*IBM Technical Disclosure Bulletin,* "Acoustical Barrier for Typewriters", Boone et al., vol. 20, No. 4, Sep. 1977, p. 1515.

*IBM Technical Disclosure Bulletin,* "Ribbon Cartridge Exit Impedance" Dowd, vol. 20, No. 118, Apr. 1977, pp. 4739–4740.

*Primary Examiner*—Ernest T. Wright, Jr.
*Attorney, Agent, or Firm*—Spencer & Frank

[57] ABSTRACT

In a ribbon cartridge for an office writing machine, which cartridge includes a housing having a base plate, a supply reel and a take-up reel mounted in the housing, a carbon ribbon wound around the reels and mounted to be conducted from the supply reel to the take-up reel while traveling over a guidance path having a first portion located outside of the housing and a second portion located inside the housing and extending between the first portion and the take-up reel, the housing being provided with an entrance opening located between the first and second portions of the guidance path for the passage of the ribbon into the housing, and the cartridge further including guide elements located for guiding the ribbon along the second path portion and a transport roller located along the second path portion for transporting the ribbon to the take up reel, the base plate is provided with recesses for damping noise generated during operation of the machine, and the cartridge is constructed for preventing particles which are detached from the ribbon over the second portion of the guidance path from falling out of the housing.

17 Claims, 9 Drawing Figures

FIG.7
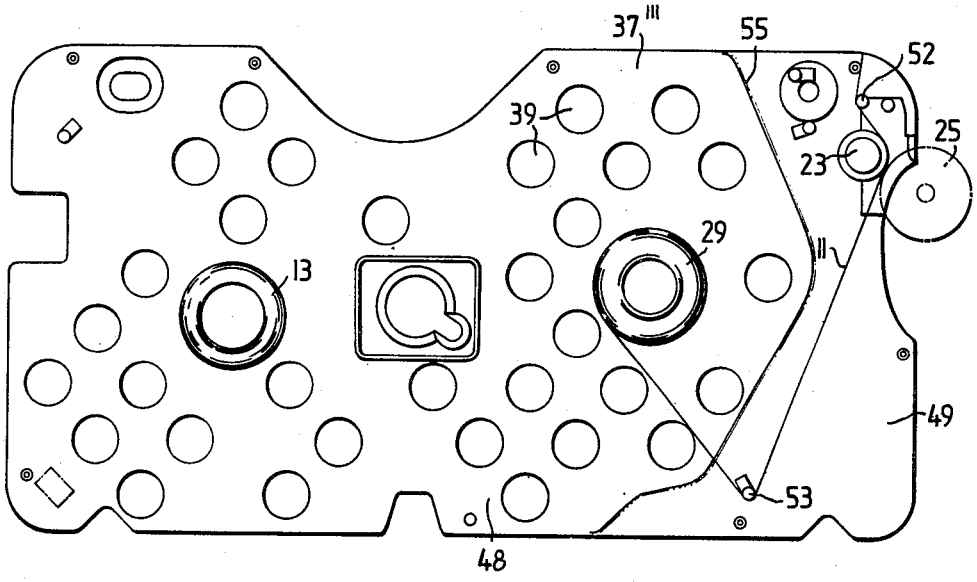
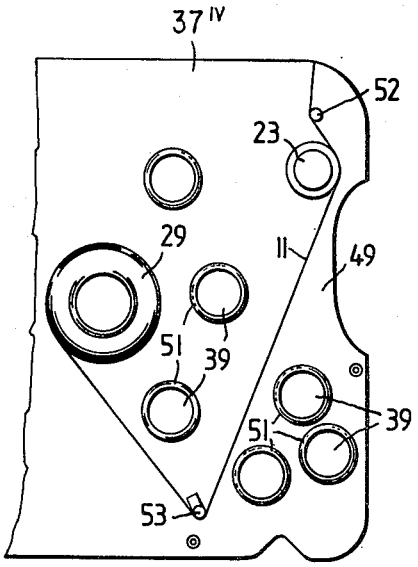
FIG.8
FIG.9
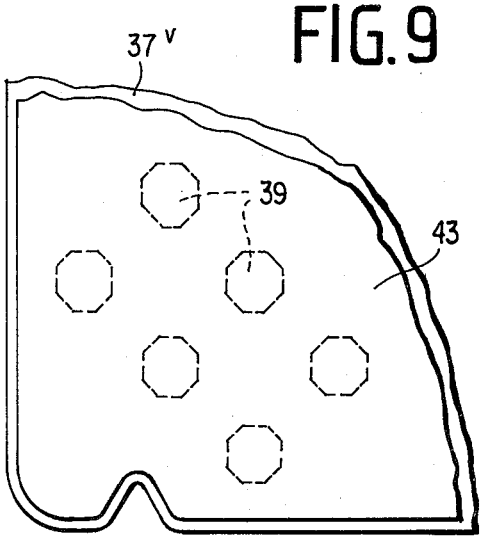

SOUND DAMPING RIBBON CARTRIDGE FOR A TYPEWRITER OR SIMILAR OFFICE MACHINE

BACKGROUND OF THE INVENTION

The present invention relates to a ribbon cartridge for a typewriter or similar office machine of the type which is constructed to achieve sound damping.

Among numerous known provisions for damping noises that are perceptible in the vicinity of typewriters and similar printing machines, especially teleprinters and memory typewriters, devices for shielding persons located in the vicinity of the machine from impact noise caused by the type characters striking the paper are becoming particularly important. Sound-absorbing hoods which either encompass the entire machine or are placed above the platen in the area where the paper is introduced have proved to be particularly effective. In the case of sound hoods which encompass the entire machine, it is still possible to observe the typewritten text through a view window; however, access for the purpose of inserting and aligning the paper and making corrections is extremely inconvenient. For this reason, sound hoods of this type are not suitable for offices where it is frequently necessary to insert new sheets of paper.

Those types of covers which are placed only over the means for introducing and removing paper in the vicinity of the platen permit the operator of the machine to reach the paper much more easily. In this case, however, the result is often that the desired degree of noise damping cannot be achieved. While the operator is generally able to observe the printed text satisfactorily with this kind of sound-absorbing hood, a particular problem is the accessibility of the printing mechanism when the type wheel and ribbon cartridge must be changed. Furthermore, the sound-absorbing hoods which cover the platen are too expensive for lower-cost typewriters intended, for example, for typing personal correspondence in the home.

Furthermore, if a machine, especially an electric typewriter, is surrounded by a housing, then a noise buildup occurs in the interior of the housing, thus increasing the noise intensity. The sound waves striking the housing from the inside or striking flat-surfaced structural parts cause parts which are capable of vibrating to vibrate, which in turn is a source of machine noise transmitted to the outside.

In order to reduce this noise buildup, a ribbon cartridge has become known whose bottom and top cover plate are provided with holes. It is true that these holes do reduce the sound buildup and reduce the intensity of noise in the interior of the housing. However, material, such as carbon particles, worn away from the used carbon ribbon because of the guidance and drive of the ribbon falls through the holes in the base plate and soils parts of the machine located below it. This soiling sooner or later causes problems with the functioning of the machine.

SUMMARY OF THE INVENTION

It is an object of the present invention to provide a novel ribbon cartridge which reduces sound buildup in the interior of the housing while at the same time effectively preventing material which is worn or rubbed off from the used carbon ribbon from falling out of the cartridge.

The above and other objects are achieved, according to the present invention, in a ribbon cartridge for an office writing machine, which cartridge includes a housing having a base plate, a supply reel and a take-up reel mounted in the housing, a carbon ribbon wound around the reels and mounted to be conducted from the supply reel to the take-up reel while traveling over a guidance path having a first portion located outside of the housing and a second portion located inside the housing and extending between the first portion and the take-up reel, the housing being provided with an entrance opening located between the first and second portions of the guidance path for the passage of the ribbon into the housing, and the cartridge further including guide elements located for guiding the ribbon along the second path portion and a transport roller located along the second path portion for transporting the ribbon to the take-up reel by the provision, in combination, of means including recesses in the base plate for damping noise generated during operation of the machine, and means functionally associated with the noise damping means for preventing particles which are detached from the ribbon over the second portion of the guidance path from falling out of the housing.

The ribbon cartridge according to the invention produces a remarkable reduction in noise in the interior of the housing, while preventing the parts of the machine located below the ribbon cartridge in its receiver device from becoming soiled. The reliability of the typewriter function is not impaired by the new ribbon cartridge. Further advantageous embodiments of the subject of the invention may be inferred from the following description.

BRIEF DESCRIPTION OF THE DRAWING

FIG. 7 is a plan view of the base plate of another preferred embodiment of a ribbon cartridge according to the invention.

FIG. 8 is a plan view of a portion of a base plate constructed according to a further second form of embodiment of the invention.

FIG. 9 is a detail plan view of part of a base plate according to another embodiment of the invention.

DESCRIPTION OF THE PREFERRED EMBODIMENTS

Figure 1:
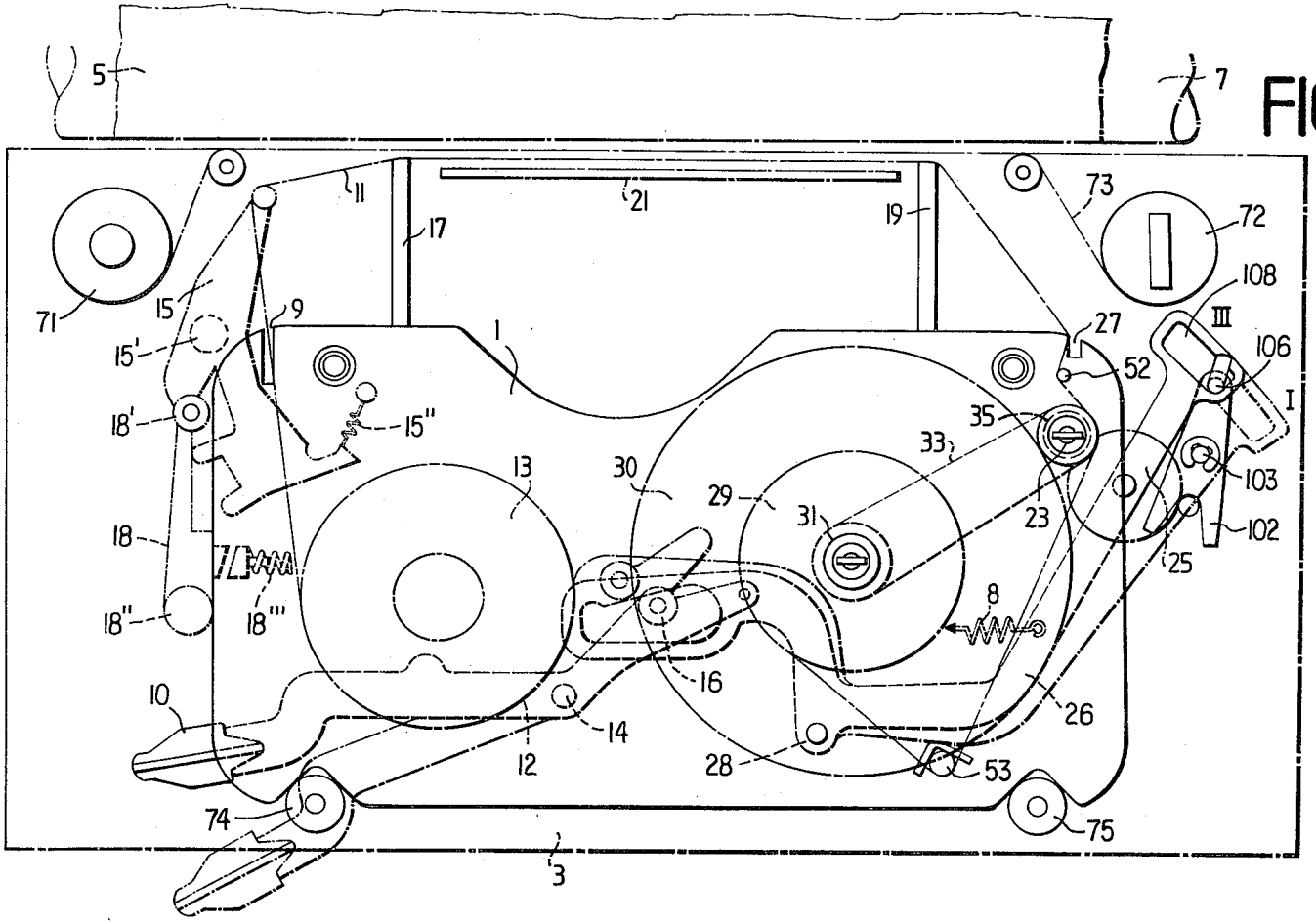
FIG. 1 is a plan view showing the basic elements of a ribbon cartridge and its receiver device.

In FIG. 1, a ribbon cartridge 1 is disposed, ready for operation, on a receiver device 3 of a typewriter or similar office machine. Cartridge 1 is displaceably disposed along a record carrier, e.g. a paper sheet, 5. The carrier 5 is disposed so as to be transportable in a known manner by a platen 7. The carbon, or ink, ribbon 11 emerging from an outlet slit 9 of the ribbon cartridge 1 is unwound from a supply reel 13 and is guided via a tensioning lever 15 and ribbon guide prongs 17 and 19 through the area between the carrier 5 and a type carrier or print wheel 21. The type carrier 21 may be, for example, a daisy wheel printer, as disclosed in U.S. Pat. No. 4,235,664. Positioning lever 15 is pivotal about an axis 15′ on receiver device 3 and is biassed by a spring 15″ connected to receiver device 3 for maintaining ribbon 11 under the desired tension. Positioning lever 15 is associated with a control lever 18 for moving lever 15 into a retracted position for insertion and removal of cartridge 1. Lever 18 is articulated to lever 15 at a pivot 18′ and is pivotal about an axis 18″ on receiver device 3. Lever 18 is biassed into the position shown by a spring 18‴ connected to receiver device 3.

After a printed impression has been made, a segment of the ribbon 11 is drawn back into the cartridge 1, through an entrance slit 27 and past a deflection guide 52, by operation of a drivable drive roller 23 and a pressure roller 25 which can be pressed against the drive roller 23, and is delivered, via a deflection guide 53, to a take-up reel 29 having a bottom flange 30. The take-up reel 29 is firmly connected with a pulley 31, and the latter is in frictional motion-transmitting contact with a second pulley 35 through the intermediary of an endless helical spring 33. The pulley 35 is drivable by a transmission forming part of the machine and described in copending U.S. application Ser. No. 230,504, filed Feb. 2, 1981 by Alfred Keiter, Wolfgang Mudder and Bernd Tappehorn.

The pressure roller 25 is carried by a mechanism which permits pressure roller 25 to be moved between a retracted position that permits cartridge 1 to be placed on, and removed from, receiver device 3. This mechanism is also illustrated, and is described in detail, in the above-cited copending U.S. application Ser. No. 230,504, and is composed essentially of locking lever 12, a pivot lever 26 carrying roller 25, and an intermediate lever 102.

Locking lever 12 is pivotal about an axis 14 on receiver device 3 and is provided with a manual handle 10. Pivot lever 26 is pivotal about an axis 28 on receiver device 3 and has one arm provided with a detent recess for engaging a detent pin 16 carried by lever 12. Pivot lever 26 is biassed counterclockwise by a biassing spring 8 connected between lever 26 and a point on receiver device 3. Intermediate lever 102 is pivotal about an axis 103 on receiver device 3 and carries an abutment pin 106 which cooperates with a recess 108 in that arm of lever 26 which carries roller 25.

When levers 12 and 26 are in the positions shown in chain lines, corresponding to position I of the arm of lever 26 carrying recess 108, roller 25 is clear of cartridge 1. When levers 12 and 26 are in the positions shown partly in solid lines and partly in broken lines, corresponding to position III of the arm of lever 26 carrying recess 108, roller 25 enters cartridge 1 and bears against the associated feed roller and lever 102 is pivoted in the counterclockwise direction.

Receiver device 3 is further provided with a conventional correction ribbon 73 extending between a supply reel 71 and a takeup reel 72, as well as positioning elements 74 and 75 which engage in recesses provided in cartridge 1 in order to accurately position cartridge 1 on receiver device 3.

Figure 2:
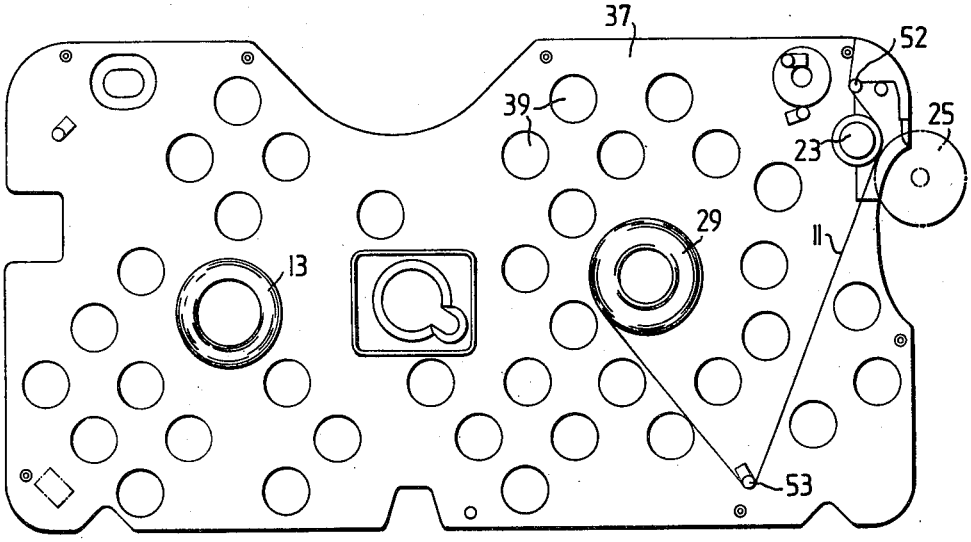
FIG. 2 is a plan view of the base plate of one preferred embodiment of the ribbon cartridge according to the invention.
Figure 3:
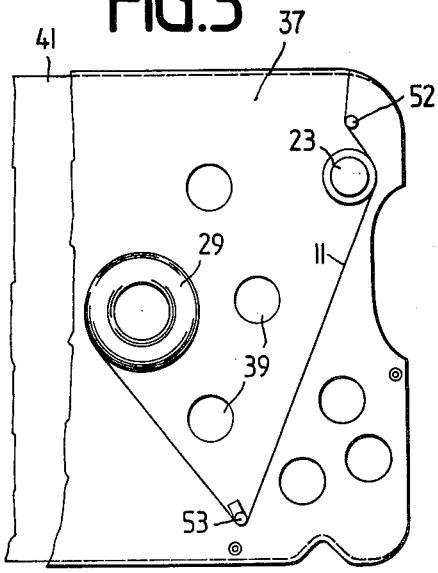
FIG. 3 is a plan view of a portion of the base plate according to a further embodiment of the invention using foil to close the openings.
Figure 4:
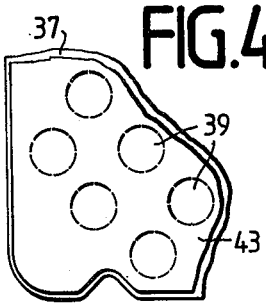
FIG. 4 is a detail plan view of part of a base plate according to another embodiment of the invention.

In the embodiment shown in FIG. 2, the base plate 37 of the ribbon cartridge 1 is provided with openings 39 which serve to reduce the buildup of noise. In order to prevent material worn off from the used part of the carbon ribbon 11 from falling directly out, the openings 39 are covered for example by an elastically deformable foil 41 which may be glued onto the base plate 37 from outside as shown in FIG. 3. Within the scope of the invention, it is also possible for a foil 43 to be placed onto the surface of the base plate 37 which will be directed inwardly in the assembled cartridge 1, in the regions provided with the openings 39, during the assembly of the supply reel 13 and the take-up reel 29, as shown in FIG. 4.

Soiling of the machine parts caused by worn-off carbon dropping out of the ribbon cartridge 1 can also be prevented by stretching foil 41 on the receiver device 3 below the location of the ribbon cartridge 1 when installed in the machine. In this case, the ribbon cartridge 1 is placed onto foil 41, which also has a favorable effect on the reduction of noise. Foil 41 would then also be arranged relative to cartridge 1 as shown in FIG. 3.

Figure 5:
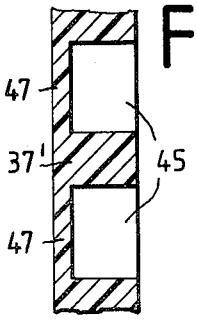
FIG. 5 is a cross-sectional side detail view of a part of a base plate according to a further embodiment of the invention.

According to a further, advantageous, embodiment of the invention, as shown in FIG. 5, the base plate 37′ may be formed so that all or some of the holes 39 may be replaced with blind holes 45, in the form of depressions, each having a membrane-like bottom 47. This embodiment is very inexpensive to produce; the foils 41 and 43 shown in FIGS. 3 and 4 are eliminated and thus no longer need to be mounted in place.

Thus the alterations in cross section provided in the base plate 37 or 37′ may be through openings 39, which have a round, polygonal or other shape in base plate 37, or blind holes 45 in base plate 37′. What is of main importance is that the ribbon cartridge 1 according to the invention yields a noticeable reduction in machine noise even in simple typewriters intended for typing personal correspondence, without there being the danger of soiling of machine parts located under the cartridge 1 by material worn off from the used carbon ribbon 11.

Also, the blind holes 45 formed as recesses need be disposed only in the vicinity of the guidance path of the used carbon ribbon 11 and of the guide elements 52 and 53 from the entrance slit 27 into the cartridge 1 up to the transport roller 23 and in the region of the periphery of the base flange 30 (see FIG. 1) of the take-up reel 29, while the recesses 39 disposed outside this area can be through openings. The blind holes 45 in this case act as receptacles to catch the worn-off carbon material particles and prevent this material from leaving the cartridge 1 and soiling the parts of the receiver device 3 located in the machine underneath the cartridge 1.

Within the scope of the invention, the blind holes 45 may be disposed in rows adjoining one another such that they form a continuous groove with individual chambers for the worn-off carbon ribbon material, located between the part of the base plate 37 of the cartridge 1 provided with through openings 39 and the part of the base plate 37 which is free of openings.

Figure 6:
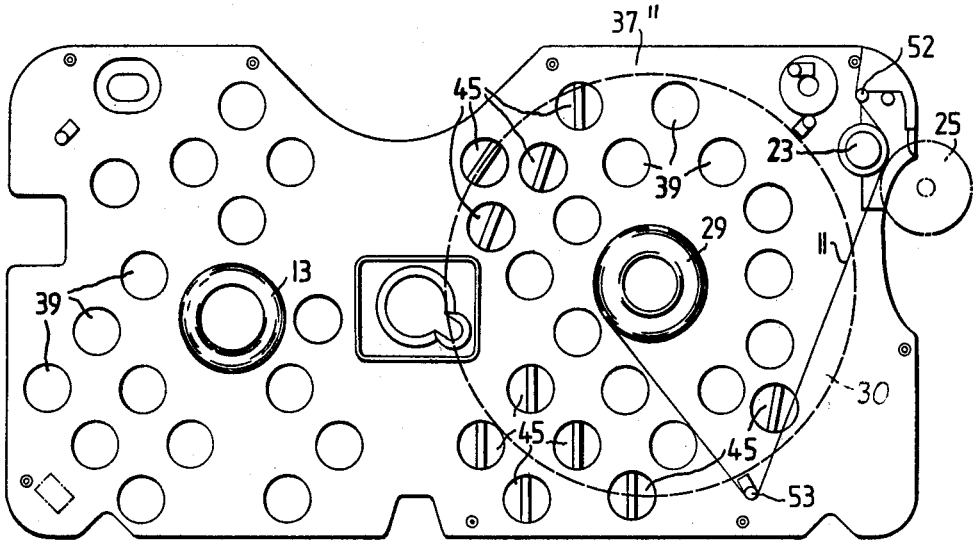
FIG. 6 is a view similar to that of FIG. 2 of the embodiment of FIG. 5.

FIG. 6 is a plan view of a base plate 37″ in which some of the through holes 39 have been replaced by the blind holes 45 shown in FIG. 5. In this embodiment, the blind holes 45 are limited to the region of the guidance path between guide elements 52 and 53 and the region adjacent the periphery of take-up reel bottom flange 30. The parallel lines significate only the blind holes 45. The openings 39 do not have these lines.

In the embodiment shown in FIG. 7, the base plate 37‴ of the ribbon cartridge 1 is provided with through openings 39 which serve to reduce the buildup of noise in the interior of the housing. In order to prevent material worn off from the used part of the carbon ribbon 11 from falling directly out, there are no openings 39 disposed in the base plate 37''' in the vicinity of the guidance path of the used carbon ribbon 11 and of the guide elements 52 and 53 leading to the take-up reel 29. In order to prevent this worn-off material in the cartridge 1 from reaching the openings 39 when the machine is being transported or is being shaken, a threshold 55 is disposed between the part 48 provided with the openings 39 and the part 49 of the base plate 37''' of the cartridge 1 lacking any openings. This threshold 55, which is simply a projection or ridge formed on plate 37''', preferably has a height of from 0.1 to 0.3 mm, and effectively prevents the soiling of machine parts by the worn-off carbon ribbon material trapped in the ribbon cartridge 1.

According to a further advantageous embodiment, the carbon ribbon wear material can be prevented from falling through by providing at least those openings 39 which adjoin the opening-free part 49 of the base plate 37$^{IV}$ with a round, collar-like threshold 51, as shown in FIG. 8. The height of each such threshold 51 is also preferably 0.1 to 0.3 mm. In accordance with this embodiment, it is naturally also possible for openings 39 surrounded by the thresholds 51 to be disposed in the part 49 of the cartridge 1.

The openings 39 provided in the base plate 37 may have a round, polygonal or other shape a polygonal shape being shown in a base plate 37$^{V}$ in FIG. 9. What is of major importance is that the ribbon cartridge 1 according to the invention enables a perceptible reduction in machine noises even in simple typewriters intended for correspondence, without there being any danger of soiling of the parts of the machine located below the cartridge 1 from material worn off from the used carbon ribbon 11.

The number and dimensions of holes 39 and 45 have been found out by empirical tests. The holes 39 and 45 are not disposed in the base plate 37 in the vicinity of the guidance path of the used carbon ribbon 11 and of bearings for the cartridge components. The diameter of the holes 39 and 45 are about 6 to 8 mm.

The foil 41 or 43 consists of an elastic material such as Polyethylene or other suitable material and has a thickness of from 0,1 to 0,2 mm.

It will be understood that the above description of the present invention is susceptible to various modifications, changes and adaptations, and the same are intended to be comprehended within the meaning and range of equivalents of the appended claims.

What is claimed is:

1. In a ribbon cartridge for an office writing machine, which cartridge includes a housing having a base plate, a supply reel and a take-up reel mounted in the housing, a carbon ribbon wound around the reels and mounted to be conducted from the supply reel to the take-up reel while traveling over a guidance path having a first portion located outside of the housing and a second portion located inside the housing and extending between the first portion and the take-up reel, the housing being provided with an entrance opening located between the first and second portions of the guidance path for the passage of the ribbon into the housing, and the cartridge further including guide elements located for guiding the ribbon along the second path portion and a transport roller located along the second path portion for transporting the ribbon to the take-up reel, the improvement comprising, in combination: means including recesses in said base plate for damping noise generated during operation of the machine; and means for preventing particles which are detached from said ribbon over the second portion of said guidance path from falling out of said housing.

2. An arrangement as defined in claim 1 wherein said recesses are through holes in said base plate, and said means for preventing particles from falling out of said housing are constituted by a portion of said base plate which surrounds said second path portion and is free of holes.

3. An arrangement as defined in claim 2 wherein said means for preventing particles from falling out of said housing further comprise a ridge projecting from the surface of said base plate which is directed toward the interior of said housing and positioned between said base plate portion which surrounds said second path portion and the remainder of said base plate.

4. An arrangement as defined in claim 3 wherein said ridge has a height of 0.1 to 0.3 mm.

5. An arrangement as defined in claim 2 wherein said means for preventing particles from falling out further comprise annular projections surrounding at least those of said through holes which are in the vicinity of said base plate portion and projecting from the surface of said base plate which is directed toward the interior of said housing.

6. An arrangement as defined in claim 5 wherein said annular projections have a height of 0.1 to 0.3 mm.

7. An arrangement as defined in claim 1 wherein said recesses have a circular cross section.

8. An arrangement as defined in claim 1 wherein said recesses are through holes in said base plate, at least some of said through holes are located in the vicinity of said second path portion, and said means for preventing particles from falling out comprise annular projections surrounding at least those of said through holes which are in the vicinity of said second path portion and projecting from the surface of said base plate which is directed toward the interior of said housing.

9. An arrangement as defined in claim 8 wherein said annular projections have a height of 0.1 to 0.3 mm.

10. An arrangement as defined in claim 1 wherein said means for preventing particles from falling out comprise solid members connected to said base plate and isolating said recesses from the region outside of said housing and adjacent said base plate.

11. An arrangement as defined in claim 10 wherein said solid members are in the form of thin bodies integral with said base plate and disposed adjacent the ends of said recesses directed toward the exterior of said housing to give said recesses the form of blind holes opening into the interior of said housing.

12. An arrangement as defined in claim 1 wherein said recesses are through holes in said base plate and said means for preventing particles from falling out comprise a flexible foil extending across said through holes.

13. An arrangement as defined in claim 12 wherein said flexible foil is disposed on the surface of said base plate which is directed toward the interior of said housing.

14. An arrangement as defined in claim 12 wherein said flexible foil is fastened to the surface of said base plate which defines an exterior surface of said housing.

15. An arrangement as defined in claim 12 wherein said flexible foil is held in the machine under tension beneath the location of said base plate when said cartridge is installed in the machine.

16. An arrangement as defined in claim 1 wherein said take-up reel includes a circular flange adjacent said base plate, said recesses include a first group of recesses in the vicinity of said second path portion and of the region adjacent the periphery of said flange and a second group of recesses in other regions of said base plate, said means for preventing particles from falling out comprise solid members connected to said base plate at the side thereof which defines an exterior surface of said housing for isolating said recesses of said first group from the region outside of said housing for causing said recesses of said first group to constitute receptacles for trapping such particles, and said recesses of said second group are through holes in said base plate.

17. An arrangement as defined in claim 1 wherein said recesses have a polygonal cross section.

* * * * *